US007061170B2

(12) United States Patent
Iwasaki

(10) Patent No.: US 7,061,170 B2
(45) Date of Patent: Jun. 13, 2006

(54) DEFLECTION YOKE HAVING MAGNETS FOR CORRECTING RASTER DISTORTION AND CATHODE-RAY TUBE APPARATUS HAVING THE DEFLECTION YOKE

(75) Inventor: Katsuyo Iwasaki, Nishinomiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/515,779

(22) PCT Filed: Nov. 20, 2003

(86) PCT No.: PCT/JP03/14782

§ 371 (c)(1),
(2), (4) Date: Nov. 24, 2004

(87) PCT Pub. No.: WO2004/049381

PCT Pub. Date: Jun. 10, 2004

(65) Prior Publication Data

US 2005/0162058 A1 Jul. 28, 2005

(30) Foreign Application Priority Data

Nov. 22, 2002 (JP) ..... 2002-340026

(51) Int. Cl.
*H01J 29/70* (2006.01)
*H01J 29/46* (2006.01)

(52) U.S. Cl. ..... 313/440; 313/441; 313/421

(58) Field of Classification Search ..... 313/421, 313/440

See application file for complete search history.

(56) References Cited

U.S. PATENT DOCUMENTS

| | | | | |
|---|---|---|---|---|
| 3,194,998 | A * | 7/1965 | Marfut | 313/156 |
| 4,159,456 | A * | 6/1979 | Smith | 335/210 |
| 4,246,560 | A | 1/1981 | Shimizu et al. | 335/212 |
| 4,376,272 | A * | 3/1983 | Osakabe et al. | 335/211 |
| 6,046,538 | A * | 4/2000 | Hishiki et al. | 313/440 |
| 6,686,688 | B1 * | 2/2004 | Fukuda | 313/440 |

FOREIGN PATENT DOCUMENTS

| | | |
|---|---|---|
| JP | 56-128552 | 10/1981 |
| JP | 07045214 | 2/1995 |
| JP | 10223156 | 8/1998 |
| JP | 2001-035413 | 2/2001 |
| JP | 2001-126642 | 5/2001 |
| JP | 2003-059427 | 2/2003 |

* cited by examiner

*Primary Examiner*—Joseph Williams
*Assistant Examiner*—Peter Macchiarolo

(57) ABSTRACT

A permanent magnet is selectively picked for a deflection yoke and provided on the periphery of the cathode ray tube for controlling the direction of an electron beam emitted towards a screen from an electron gun. The permanent magnet can adjust an irradiating point of the electron beam. The permanent magnet incorporates a magnetic substance that can be applied to at least one of the end faces of the magnet with a negative temperature characteristic. The magnetic substances can have different configurations and based on the saturation flux density of the permanent magnet, can be selected to match the permanent magnet to correct variation in the saturation flux density.

19 Claims, 9 Drawing Sheets

DEFLECTION YOKE HAVING MAGNETS FOR CORRECTING RASTER DISTORTION AND CATHODE-RAY TUBE APPARATUS HAVING THE DEFLECTION YOKE

TECHNICAL FIELD

The present invention relates to a deflection yoke and a cathode-ray tube apparatus, and especially relates to a technology of raster distortion correction.

BACKGROUND ART

In a cathode-ray tube (hereafter CRT) apparatus used in televisions and the like, electron beams are emitted from the electron gun and deflected by a magnetic field which is created by the deflection yoke provided on the periphery of the funnel of the CRT. These deflected electron beams scan over the panel, which results in visual display. Here, the panel provided with a screen, which is a face irradiated by the electron beams, does not have a spherical surface centering on the deflection center of the electron beams, and the distance between the deflection center and a point irradiated by the electron beams increases towards the perimeter of the screen. Consequentially, deviation of the electron beams becomes most significant in the four corners of the screen, which leads to one type of raster distortion, pincushion distortion, as shown in FIG. 9A.

As to pincushion distortion shown in FIG. 9A, the distortion in the x-direction, horizontal pincushion distortion, is usually corrected by a deflection circuit for horizontal pincushion distortion, whereas the distortion in the y-direction, vertical pincushion distortion, is eliminated or reduced by placing a pair of permanent magnets at the top and bottom front edges of the deflection yoke frame to the panel side (see, e.g. Japanese Patent Publication No. 58-20455 and No. 63-18836). With the aid of FIG. 9B, the following describes the principle of the distortion correction. FIG. 9B is a pattern diagram illustrating an influence on the electron beams above the tube axis of the CRT, which is exerted by the permanent magnet.

In reference to FIG. 9B, the permanent magnet is placed with the N pole on the right side in the x-direction, and the S pole, left, as shown in FIG. 9B. Each electron beam of R, G, and B travels in the direction of the tube-axis (i.e. in the direction out of the page). The permanent magnet creates a leftward magnetic field perpendicular to the tube-axis direction over the traveling range of electron beams. Due to the effect of this magnetic field, an upward Lorentz force acts upon the electron beams. Since the magnet is provided on the y-axis of the CRT apparatus, the electron beams scanning closer to the central part of the panel's screen in the horizontal direction, (i.e. the x-direction), experience a larger Lorentz force, which allows for correction of the pincushion distortion.

Although it is not shown in the figure, another permanent magnet is symmetrically placed at the bottom front edge of the deflection yoke, opposite to the one at the top deflection yoke in respect to the tube-axis, with the magnetic poles flipped. The pincushion distortion at the bottom of the screen is corrected by this permanent magnet located at the bottom.

When the CRT apparatus is activated, temperature of the apparatus starts increasing from the start of the activation. The temperature differential range is subjected to the ambient temperature of the environment in which the CRT apparatus is placed, but it can be, for instance, several tens of degrees Celsius (° C.). Thus, in the case that activating the apparatus results in an increase in the temperature thereof, the magnetization of the permanent magnet changes with a negative temperature characteristic. When the magnetization of the permanent magnet changes with a negative temperature characteristic, proper correction over the pincushion distortion cannot be maintained any longer.

As a countermeasure for this problem, a technique has been developed (see, Japanese Laid-Open Patent Application No. 2001-126642). In this, a magnetic substance made of a metal alloy having an attribute in which the permeability changes with a negative temperature characteristic is attached to the outer lateral face of the permanent magnet provided on the deflection yoke frame. This allows correction of the pincushion distortion to be maintained against temperature change of the apparatus.

As to a CRT apparatus, late years, there is a trend toward making the panel flat. However, such a CRT apparatus with a flat panel needs to be attached with a permanent magnet with a larger magnetization in order to correct pincushion distortion. For example, compared to a conventional CRT apparatus, a CRT apparatus with a panel like this requires the magnetization of the permanent magnet to be three to five times larger. Thus, in this type of CRT apparatus, change in the magnetization of the permanent magnets in response to temperature change becomes significant, and therefore, a problem has arisen where the method of distortion correction cited in Japanese Laid-Open Patent Application No. 2001-126642 above is not quite competent to correct the pincushion distortion against temperature change of the apparatus. In short, as to the permanent magnet with a large magnetization, the change in the magnetization against temperature change is substantial. And thus, even if the magnetic substance, which is made of a metal alloy having the attribute where the permeability changes with a negative temperature characteristic, is attached as above, sufficient adjustment cannot be made for change in the correction efficiency against the raster distortion in response to change in the magnetization of the permanent magnet.

An additional problem occurs since variation in the magnetization among individual permanent magnets increases when the permanent magnets have a larger magnetization. That is, proper correction of the pincushion distortion cannot be obtained when such a permanent magnet is used in the CRT apparatus. Such a problem, i.e. the variation in the magnetization of the permanent magnets, may be solved in theory; namely, by employing additional manufacturing steps that include screening over the permanent magnets and using only the most appropriate permanent magnets at the manufacturing stage of the CRT apparatus. However, adopting such a method is impractical cost wise.

DISCLOSURE OF THE INVENTION

In view of the above-mentioned problems, the present invention aims to compensate for the variation in the magnetization caused by the individual difference of the permanent magnets, and further to provide a deflection yoke as well as a CRT apparatus provided with the deflection yoke which maintain proper correction of the raster distortion against temperature change of the apparatus.

In order to accomplish the above objects, the deflection yoke and the CRT apparatus of the present invention are characterized as follows.

(1) A deflection yoke (i) is placed on the periphery of a CRT, (ii) applies a deflection magnetic field to an electron beam emitted towards the screen from an electron gun which is mounted in the neck of the cathode-ray tube, and (iii)

controls the electron beam to scan across the screen. This deflection yoke contains a magnet for adjusting an irradiated point of the electron beam on the screen. Within the magnet, a magnetic substance whose permeability changes with a negative temperature characteristic is attached on at least one of both end faces, S and N poles.

The deflection yoke of the present invention contains the magnet provided in order to correct the pincushion distortion as well as the magnetic substance having an attribute in which the permeability changes with a negative temperature characteristic. The magnetic substance is attached to the end face, which is a magnetic pole (S pole or N pole) of the magnet. By means of this structure, a bypass of magnetic field lines is formed between the affixed magnetic substance and the opposite magnetic pole of the magnet. Consequentially, the magnetic field line having an influence on the electron beams are efficiently adjusted by concentrating the magnetic field lines running out of the magnet into the bypass mentioned above. In the deflection yoke, the magnetization of the magnet decreases in response to an increase in temperature, which results in an overall decrease in the magnetic field lines running out of the magnet. However, the proportion of the magnetic field lines passing through the bypass, which is formed by the attachment of the magnetic substance, is also lowered. As a result, the function for correcting the raster distortion is maintained. At the same time, by means of attaching the magnetic substance to the end face of the magnet as mentioned above, a decreasing rate of the density of the magnetic field lines passing through the bypass is also accelerated with an increase in temperature, and therefore the effect for adjusting the change in the magnetic field lines running out of the magnet in response to temperature changes is eminent.

Accordingly, the deflection yoke of the present invention, being free from the influence of ambient temperature, always demonstrates stable correction of the raster distortion.

Furthermore, in the deflection yoke of the present invention, the variation in the magnetization of the magnets due to the individual difference is reduced even if a magnet with a large magnetization is placed on the deflection yoke in order to accommodate the pincushion distortion correction of the CRT apparatus with a flat panel. Namely, this is realized by preparing a plurality of magnetic substances differing in the permeability and the temperature characteristics thereof, and selecting and attaching a magnetic substance with the most appropriate attributes according to the magnetization of each magnet.

Compared to the case of screening the magnets to minimize their variation, this manufacturing technique requires less manpower which leads to cost reduction.

In addition, the deflection yoke of the present invention allows for effective adjustment against change in the magnetization of the magnet due to temperature change by means of attaching the magnetic substance to the end face of the magnet, which is the magnetic pole of the magnet. In short, the deflection yoke of the present invention enables adjustment to the magnetization, affecting where magnetic flux density is higher, in comparison to the deflection yoke disclosed in Japanese Laid-Open Patent Application No. 2001-126642. In this conventional deflection yoke, the magnetic substance is attached to the lateral face which is not a magnetic pole of the magnet. Now therefore, the deflection yoke of the present invention functions well to adjust change in the magnetization in response to temperature change even when a magnet with a large magnetization is used in order to accommodate the CRT apparatus with a flat panel.

Consequently, the deflection yoke of the present invention proves effective in compensation for the variation in the magnetization of the permanent magnets due to individual difference, and also in constructing a CRT apparatus in which proper raster distortion correction is maintained against temperature change of the apparatus.

(2) In the deflection yoke of (1) above, the magnet is in the shape of a column that has one or more lateral faces. The magnetic substance includes a basal plane and two open edges extending from the basal plane, and is provided on the magnet in a manner that the basal plane spans one of the end faces covering a part of the one end face while each of the two open edges covers a part of the one or more lateral faces of the magnet.

(3) In the deflection yoke of (2) above, the magnet has a rectangular cross-section with four lateral faces. The magnetic substance has another two open edges extending from the basal plane, thereby having four open edges in total. The magnetic substance is attached to the magnet in a manner that each of the four open edges covers a part of the respective four lateral faces of the magnet.

(4) In the deflection yoke of (1) above, the magnetic substance is made of a metal alloy containing at least one of Fe, Ni, and Cr. An Fe—Ni metal alloy and an Fe—Ni—Cr metal alloy are concrete examples of this.

(5) In the deflection yoke of (1) above, the magnet is provided at a position on the frame of the deflection yoke. The position on the frame is to the screen side of the CRT.

(6) In the deflection yoke of (5) above, a pair of magnets, each of which is attached by the magnetic substance, are provided, and the paired magnets are symmetrically placed opposite to each other in respect to a tube axis of the CRT.

(7) In the deflection yoke of (6) above, magnetic substances, each of which attaches to the paired magnets, have a substantially identical characteristic of permeability change in response to change in temperature.

Note that the term "substantially identical" here indicates the attributes of the magnetic substances are identical insofar as temperature characteristics of the magnets can be practically adjusted.

(8) A CRT apparatus comprises a cathode-ray tube and a deflection yoke. The cathode-ray tube further includes (i) a panel which contains a screen inside, (ii) a neck which mounts an electron gun placed opposite to the panel, and (iii) a funnel which joints the panel and the neck. In the CRT, an electron beam is emitted from the electron gun towards the screen. The deflection yoke (i) is placed on the periphery of the cathode-ray tube, (ii) applies a deflection magnetic field to the electron beam emitted towards the screen from the electron gun which is mounted in the neck of the cathode-ray tube, and (iii) controls the electron beam to scan across the screen. The deflection yoke contains a magnet for adjusting an irradiated point of the electron beam on the screen. Within the magnet, a magnetic substance whose permeability changes with a negative temperature characteristic is attached on at least one of both end faces, S and N poles.

The CRT apparatus of the present invention is provided with the deflection yoke. As stated above the deflection yoke contains the magnet provided in order to correct the pincushion distortion as well as the magnetic substance having an attribute in which the permeability changes with a negative temperature characteristic. The magnetic substance is attached to the end face of the magnet, which is a magnetic pole (S pole or N pole) of the magnet. By means of this structure, a bypass of magnetic field lines is formed between the affixed magnetic substance and the opposite magnetic pole of the magnet. Consequentially, changes in the magnetization of the magnet in response to temperature changes are adjusted, with a potent influence over the magnetic field lines running from the magnet. Now therefore, in the CRT apparatus of the present invention, the raster distortion is corrected well irrespective of the temperature change.

In addition, the magnetic substance is attached to the end face of the magnet as described above, and this enables the magnetic substance to exert a substantial effect on the magnetic field lines running out of the magnet. As a result, the magnetization is adjusted well even for the magnets with significant variation in the magnetization.

Hence, the CRT apparatus of the present invention has high quality performance, compensating the variation in the magnetization of the permanent magnets caused by individual difference, and maintaining proper correction of the raster distortion against temperature changes of the apparatus.

(9) In the CRT apparatus of (8) above, the magnet is in the shape of a column that has one or more lateral faces. The magnetic substance includes a basal plane and two open edges extending from the basal plane, and is positioned on the magnet in a manner that the basal plane spans one of the end faces covering a part of the one end face while each of the two open edges covers a part of the one or more lateral faces of the magnet.

(10) In the CRT apparatus of (9) above, the magnet has a rectangular cross-section with four lateral faces. The magnetic substance has another two open edges extending from the basal plane, thereby having four open edges in total. The magnetic substance is attached to the magnet in a manner that each of the four open edges covers a part of the respective four lateral faces of the magnet.

(11) In the CRT apparatus of (14) above, the magnetic substance is made of a metal alloy containing at least one of Fe, Ni, and Cr. An Fe—Ni metal alloy and an Fe—Ni—Cr metal alloy are concrete examples of this.

(12) In the CRT apparatus of (8) above, the magnet is provided at a position on the frame of the deflection yoke. The position on the frame is to the screen side of the CRT.

(13) In the CRT apparatus of (12) above, a pair of magnets, each of which is attached by the magnetic substance, are provided, and the paired magnets are symmetrically placed opposite to each other in respect to a tube axis of the CRT.

(14) In the CRT apparatus of (13) above, the magnetic substances, each of which attaches to the paired magnets, have a substantially identical characteristic of permeability change in response to change in temperature.

Note that the term "substantially identical" here indicates the attributes of the magnetic substances are identical insofar as temperature characteristics of the magnets can be practically adjusted.

(15) In the CRT apparatus of (8) above, a shadow mask is provided close to the screen which is placed in the panel. The shadow mask is tensed and then maintained.

BEST MODE FOR CARRYING OUT THE INVENTION

A CRT apparatus 1 is given below by way of example to illustrate the best embodiment of the present invention.

(1) Overall Structure of the CRT Apparatus 1

Figure 1:
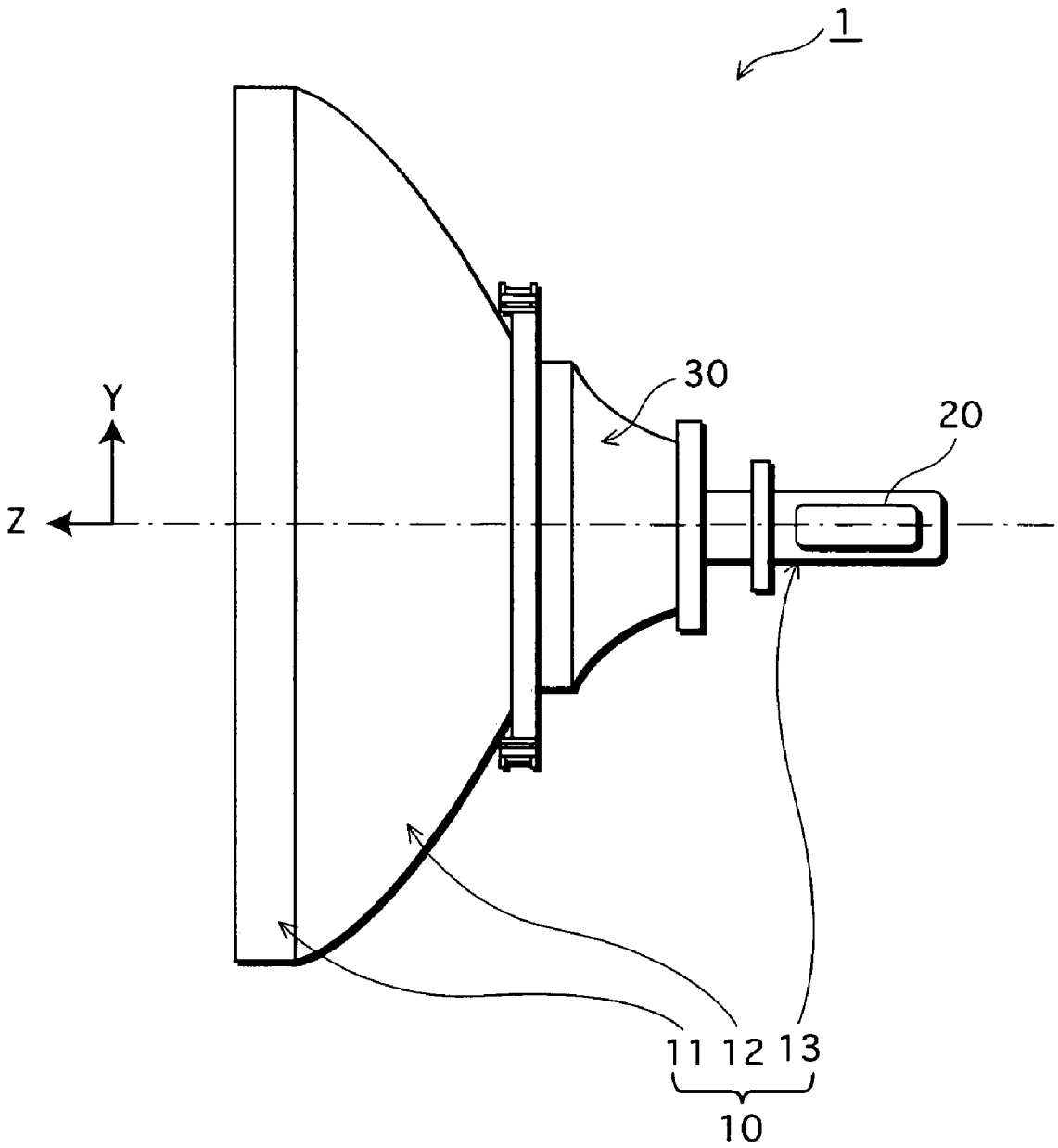
FIG. 1 is a side view illustrating main components of the CRT apparatus 1 according to the preferred embodiment of the present invention.

The overall structure of the CRT apparatus 1 is described by the aid of FIG. 1. FIG. 1 is a side view of the CRT apparatus 1 with selected main components thereof.

As shown in FIG. 1, the CRT apparatus 1 has an air-tightened container, the CRT 10, and a deflection yoke 30 set on the periphery of the CRT 10. The CRT 10 is composed of a panel 11 with a phosphor screen (not shown) provided inside; a neck 13 where an electron gun 20 is mounted; and a funnel 12 jointing the panel 11 and the neck 13.

The electron gun 20 is an inline gun and comprises firing units for three electron beams of blue (B), green (G), and red (R).

The deflection yoke 30, whose structure is described later, is placed in the space between the funnel 12 and the neck 13 of the CRT 10 so as to follow the periphery of these two.

(2) Structure of the Deflection Yoke 30

Figure 2:
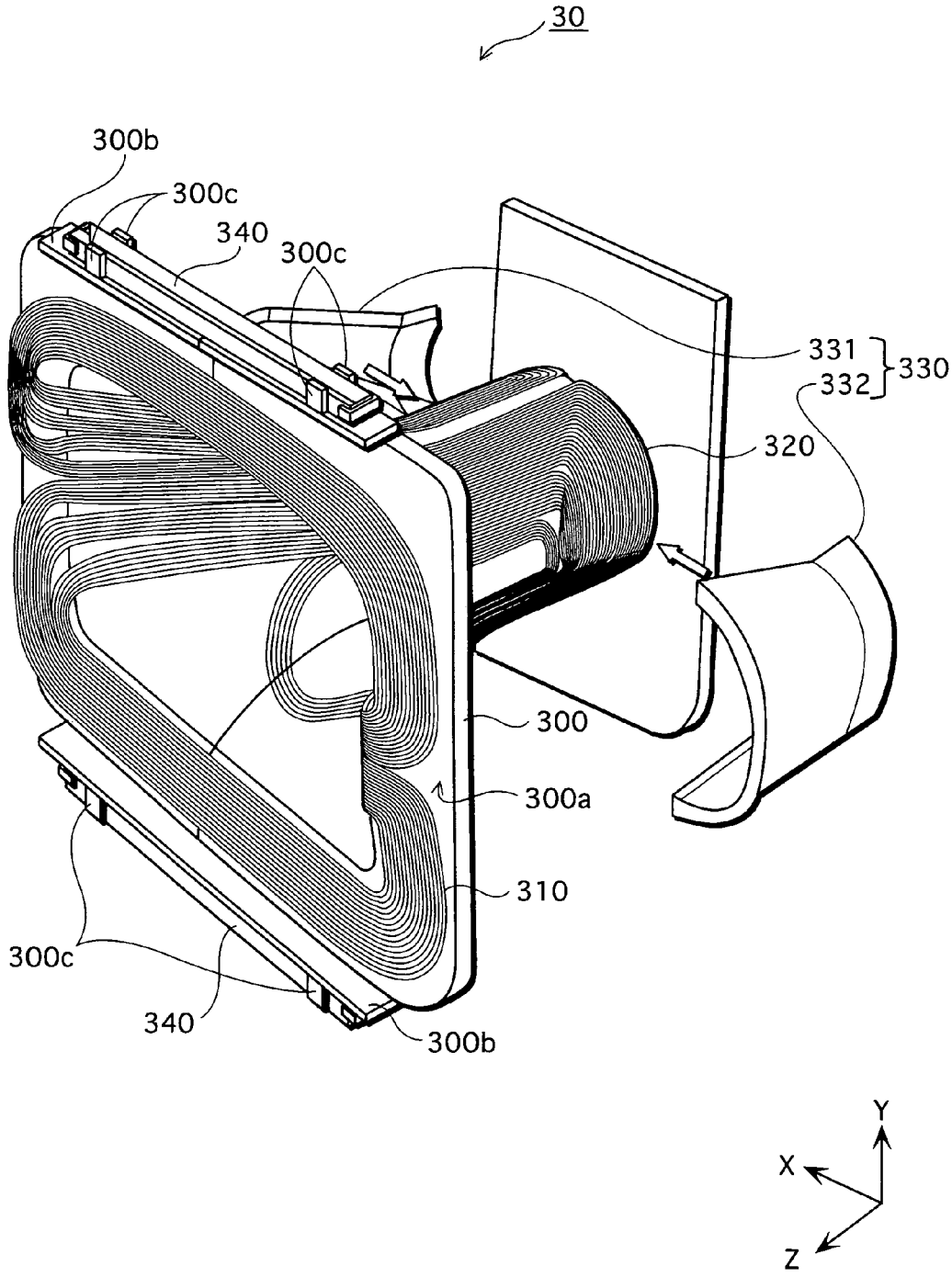
FIG. 2 is a perspective view of the deflection yoke 30 of the CRT apparatus 1.
Figure 3:
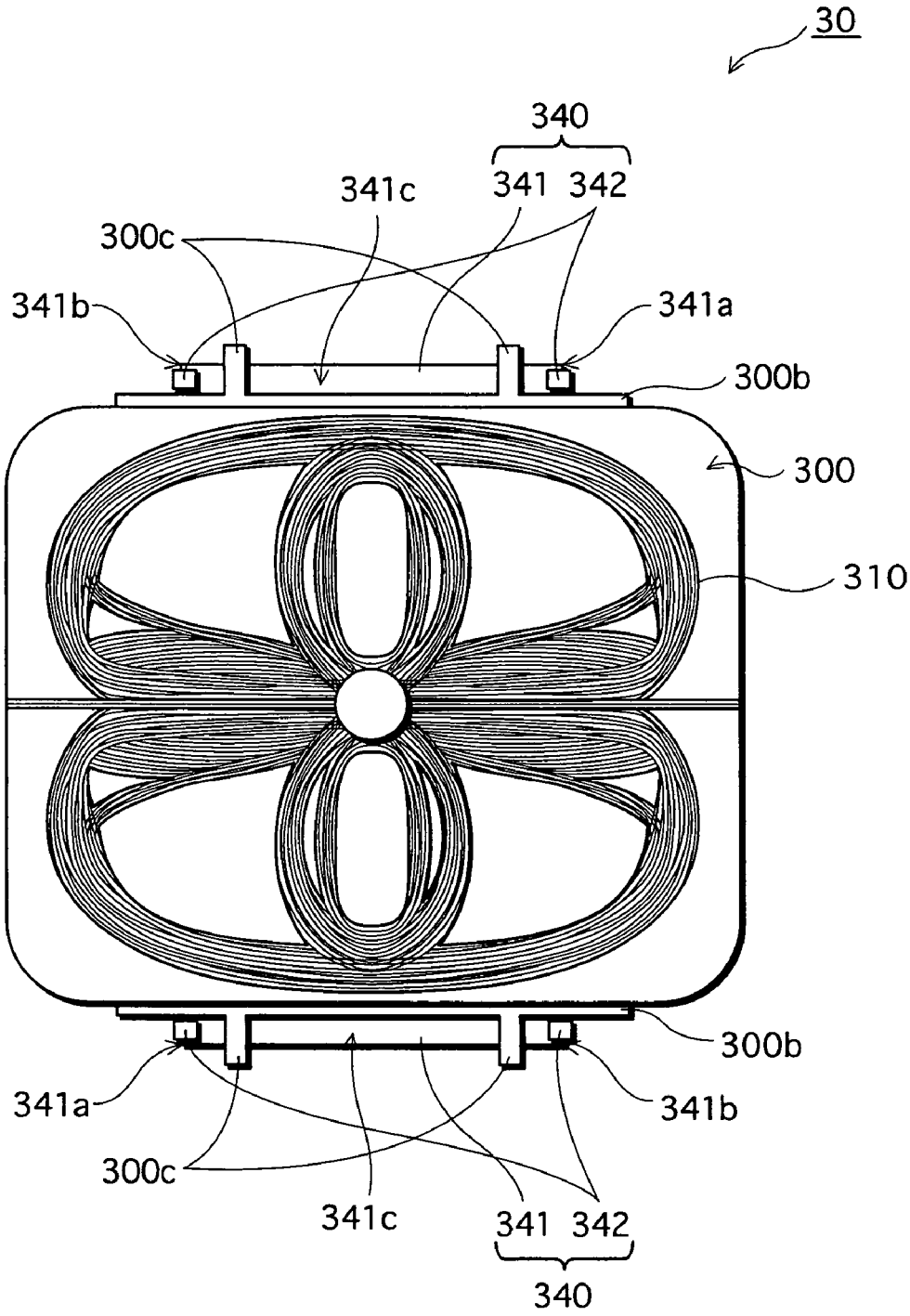
FIG. 3 is a front view of the deflection yoke 30.

Among the components of the CRT apparatus 1, the deflection yoke 30 is a feature of this preferred embodiment. FIGS. 2 and 3 are used to give an account of the structure of the deflection yoke 30. FIG. 2 is a perspective view of the deflection yoke 30, and FIG. 3 is a front view of the same seen from the side of the panel 11.

As illustrated in FIG. 2, the deflection yoke 30 is made up of a frame 300; a horizontal deflection coil 310; vertical deflection coil 320; and a ferrite core 330. The frame 300 is formed in the shape of a funnel to follow the peripheral shape of the funnel 12 and the neck 13 in the CRT 10 shown in FIG. 1 above. The saddle-type horizontal and vertical deflection coils 310 and 320 are placed along the internal and external surfaces of the frame 300, respectively. The ferrite core 330 is placed to cover the outside of the vertical deflection coil 320.

In addition, the ferrite core 330 is structured by combining a pair of core members 331 and 332, symmetrically matched half pipes.

Of components of the deflection yoke 30, the frame 300 is made of a platy insulator (a resin molded product) with approximately uniform thickness across the board, and the portion on the screen side following the above funnel-shaped portion is built into the shape of a substantially square picture frame. Hereafter, this portion, which is in the shape of a picture frame, is referred to as a foreside frame 300*a*.

Platform portions 300*b* are formed so as to project from the top and bottom edges of the foreside frame 300*a* located in the y-direction toward the front in the z-direction (i.e. in the direction toward the panel 11 shown in FIG. 1 above). Four tabs 300*c* each are provided in the y-direction extending from the platform portion 300*b*. Columnar correction units 340 are mounted and glued with an adhesive and such onto the platform portions 330*b*, and clipped with individual tabs 300*c*.

As shown in FIG. 3, the correction units 340 are attached, one each on the top and the bottom of the foreside frame 300*a*. Each correction unit 340 includes a permanent magnet 341 placed midway in the longitudinal direction; and magnetic substances 342 which are affixed to both end faces 341*a* and 341*b* of the permanent magnet 341. The magnetic substances 342, each being substantially square-bracket shaped as viewed in the y-direction in FIG. 2, are affixed to the permanent magnet 341 using an adhesive and the like. Here, as illustrated in FIGS. 2 and 3, the magnetic substances 342 are affixed so as to cover part of the respective end faces 341*a* and 341*b* as well as part of the lateral face 341*c* of the permanent magnet 341.

The end faces 341*a* and 341*b* of the permanent magnet 341, to which the magnetic substances 342 are affixed, are an N and a S pole, respectively.

Two correction units 340, making a pair, each of which is attached at the top and the bottom of the foreside frame 300*a*, are symmetrically placed opposite to each other in respect to the tube axis of the CRT 10. In other words, as shown in FIG. 3, the correction units 340 attached at the top and the bottom of the foreside frame 300*a* are arranged so that a magnetic pole of one permanent magnet 341 faces the opposite magnetic pole of the other on either side, right or left, of the figure.

Note here that, with the CRT apparatus 1 of this preferred embodiment, one end face 341*a* of the permanent magnet 341 in each correction unit 340 is an N pole and the other end face is a S pole.

(3) Structure of the Correction Unit 340

Figure 4A:
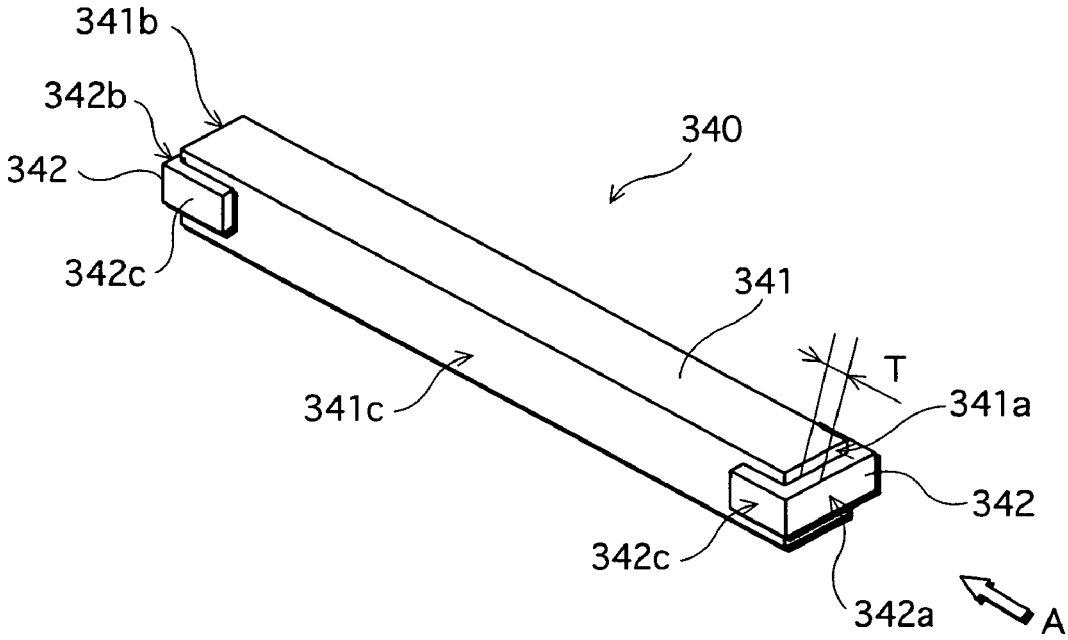
FIG. 4A is a perspective view of the correction unit 340 provided with the deflection yoke 30.
Figure 4B:
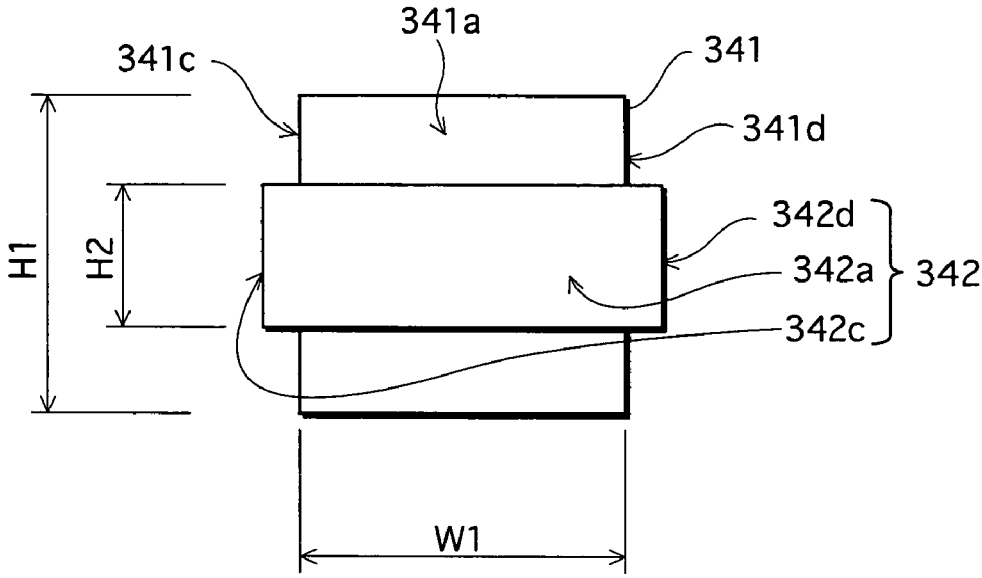
FIG. 4B is an end view of the correction unit of FIG. 4A.

With the aid of FIG. 4, the following describes the correction unit 340 in more detail. FIG. 4A is a perspective view illustrating the structure of the correction unit 340, and FIG. 4B is an end view of the correction unit 340 of FIG. 4A, taken in the direction of the arrow A.

As shown in FIG. 4A, the correction unit 340 is composed of the permanent magnet 341 and the magnetic substances 342. While the permanent magnet 341 has the shape of a prism, each of the magnetic substances 342 is substantially square-bracket shaped in a plan view as above stated. More specifically, each magnetic substance 342 is made up of first-parts (basal planes) 342*a* and 342*b*, which cover part of the end faces 341*a* and 342*b*, respectively, and second-parts (open edges) 342*c* covering part of the lateral face 341*c*. Herewith, the magnetic substances 342 form a bypass of magnetic field lines, running from the permanent magnet 341, between the second part 342*c* on one pole side and the second part 342*c* on the other pole.

The magnetic substance 342 has an attribute in which the permeability changes with a negative temperature characteristic. A metal alloy containing, for instance, Ni, Fe, or Cr, can be used to form a magnetic substance with such an attribute. To be more precise, an Fe—Ni metal alloy and an Fe—Ni—Cr metal alloy (e.g. product name: Temperature Compensator Alloy, item numbers: MS-1, MS-2, and MS-3, produced by Sumitomo Special Metals Co., Ltd) can be used.

There are no restrictions on a type of the permanent magnet 341 to be used. One with the main material of $BaO.6Fe_2O_3$ is an example of this.

As shown in FIGS. 4A and 4B, the size of the magnetic substance 342 needs to be determined in compliance with the magnetization of the permanent magnet 341, to which the magnetic substance 342 is affixed. When, for example, the magnetic substance 342 has a thickness T=1.0 mm and the end face 341*a* of the permanent magnet 341 has dimensions H1=W1=9 mm, the height H2 of the magnetic substance 342 is determined at 4.0 mm.

The width of the magnetic substance 342 conforming to the width of the permanent magnet 341, W1, is set at (W1+2T), as indicated in FIG. 4B.

Note that the magnetic substance 342 does not necessarily need to be square-bracket shaped in a plan view, and the magnetic substance 342 attachable to the surfaces of the end faces 341*a* and 341*b*, each of which is a magnetic pole of the permanent magnet 341, is acceptable for use.

(4) Magnetic Field Adjustment by the Correction Unit 340

Figure 5A:
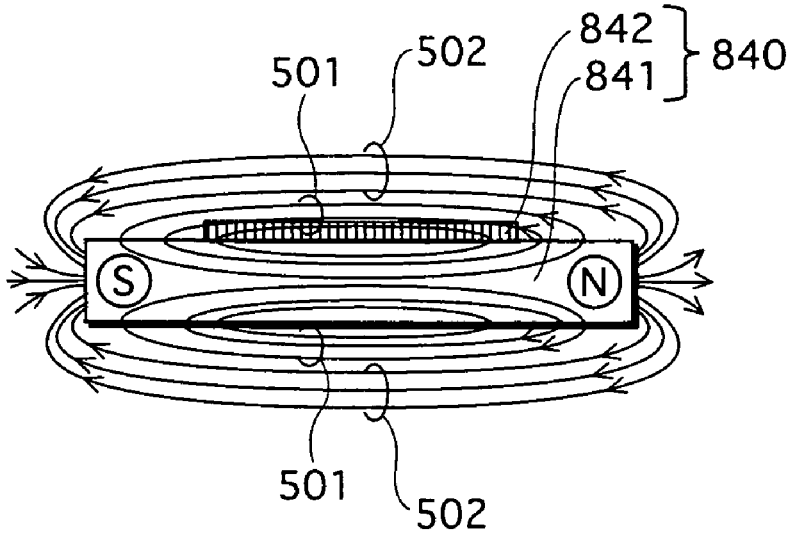
FIG. 5A is a conceptual diagram illustrating a distribution of the magnetic field which the correction unit 840 of the prior art acts upon.
Figure 5B:
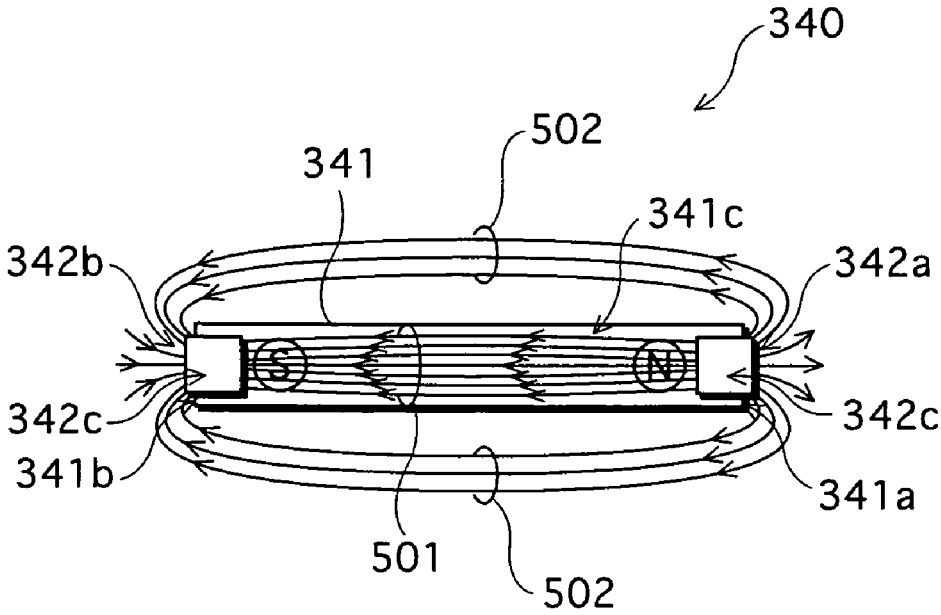
FIG. 5B is a conceptual diagram illustrating a distribution of the magnetic field which the correction unit 340 of the deflection yoke 30 acts upon.

Referring to FIG. 5, the following gives an account of a magnetic field generated by the correction unit 340, which is provided with the deflection yoke 30 of the CRT apparatus 1. FIG. 5A is a conceptual diagram illustrating a magnetic field generated by a correction unit 840, which is an embodiment provided with a deflection yoke disclosed in the above Japanese Laid-Open Patent Application No. 2001-126642, hereafter "prior art." FIG. 5B is a conceptual diagram illustrating a magnetic field generated by the correction unit 340 which is provided with the deflection yoke 30 of this preferred embodiment.

As shown in FIG. 5A, in the correction unit 840 of the prior art, a magnetic substance 842 is affixed to one lateral face of a permanent magnet 841. As to this correction unit 840, an analysis on magnetic field lines running from the permanent magnet 841 shows that the magnetic field lines are, in large part, conceptually divided into two constituents: a magnetic-field-line constituent 501 running from parts other than the faces of the magnetic poles, i.e. the lateral faces, in the permanent magnet 841; and a magnetic-field-line constituent 502 pointing from the N pole toward the S pole. The magnetic-field-line constituent 501 is not as strong as the magnetic-field-line constituent 502, and it is the magnetic-field-line constituent 502 that, in fact, has a larger effect upon the electron beams in a CRT apparatus.

Accordingly, in the correction unit 840 of the prior art, the magnitude of the magnetic field is adjusted by exerting an influence on the magnetic-field-line constituent 501 whose effects on the electron beams are small since the magnetic substance 842 is affixed to the lateral face of the permanent magnet 841, as illustrated in FIG. 5A.

On the other hand, in the correction unit 340 provided with the deflection yoke 30 of this preferred embodiment, the magnetic substances 342 are affixed to the permanent magnet 341 so as to cover part of both end faces 341*a* and 341*b*, which are two magnetic poles (N and S poles) of the permanent magnet 341, as well as part of the lateral face 341*c*. This results in a formation of a bypass of the magnetic field lines, running out of the permanent magnet 341, between both magnetic substances 342, as shown in FIG.

5B. Accordingly, by these two magnetic substances 342 affixed to the permanent magnet 341 covering the end faces 341*a* and 341*b* of the two magnetic poles along with the lateral face 341*c*, the magnetic field lines from the permanent magnet 341 are divided into two constituents: a magnetic-field-line constituent 501 concentrating into the bypass; and a magnetic-field-line constituent 502 which exerts a substantive influence on the electron beams.

The correction unit 340 of this preferred embodiment exercises a great effect on the magnetic field lines from the permanent magnet 341 since the end faces 341*a* and 341*b* of the permanent magnet 341 are covered as shown in FIG. 5B. Consequently, in the correction unit 340, the magnetic substance 342 absorbs the magnetic field lines of the permanent magnet 341, and the magnetic-field-line constituent 501 of the absorbed magnetic field lines is guided to the bypass formed between the second-parts 342*c*, each of which is affixed to the side of the N and S pole of the magnetic substances 342. As a result, the correction unit 340 allows for effective adjustment, exerting a potent influence on the constituent of the magnetic field which has a substantial effect on the electron beams.

Hence, the correction unit 340 of this preferred embodiment enables compensation to be made for the variation in the magnetization of the permanent magnet 341, as well as efficient adjustment of the magnetization of the permanent magnet 341 in response to temperature change, even where the permanent magnet 341 with large magnetic force is used in connection with a trend toward a flat panel.

Note here that, when two correction units 340 are attached in a pair, at the top and bottom of the deflection yoke 30, it is advisable to use the correction units 340 whose attributes, including the magnetization of the permanent magnet 341 and properties of the magnetic substances 342, are substantially identical.

(5) Compensation Method for the Variation in the Magnetization of the Correction Unit 340

In general, as for the permanent magnet, the larger the magnetization required, the more significant the variation in the magnetization becomes due to the individual difference as described above. If such a permanent magnet is applied to the deflection yoke without change, the pincushion distortion cannot be corrected as planned. In this instance, a process, in which a plurality of permanent magnets are prepared in advance and a permanent magnet with a desirable magnetization is used after screening, cannot be taken on, due to the number of manufacturing steps and so on.

Figure 6A:
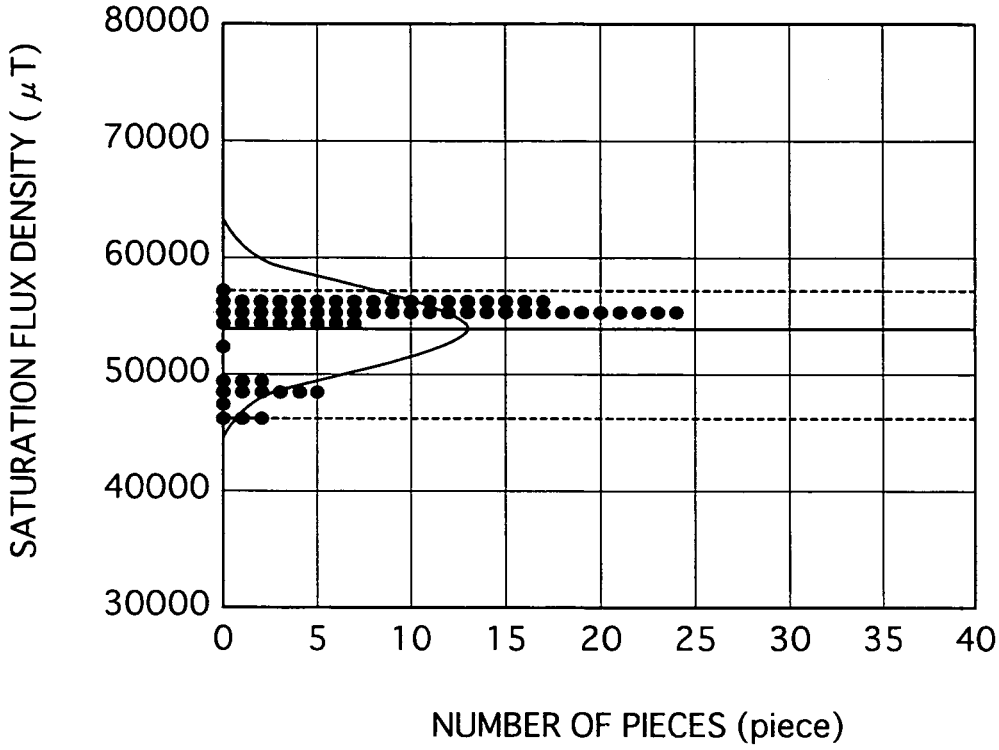
FIG. 6A is a distribution diagram showing variation in the saturation flux density of the permanent magnet 341.
Figure 6B:
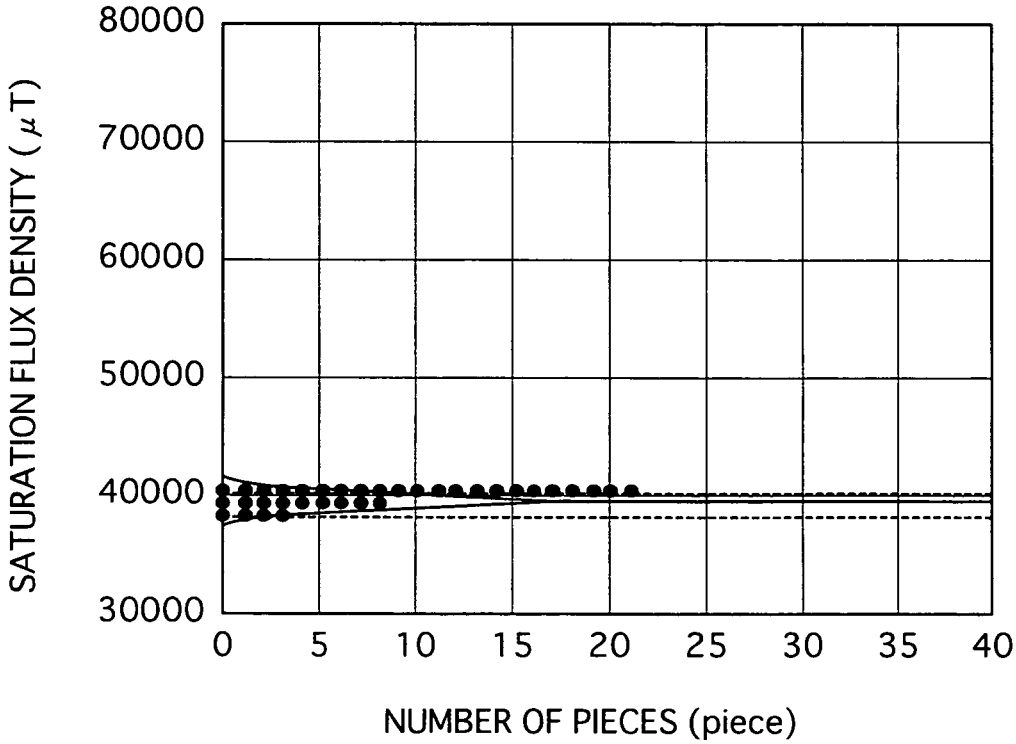
FIG. 6B is a distribution diagram showing variation in the saturation flux density of the correction unit 340 in which the magnetic substance 342 is attached to the permanent magnet 341.

Given this factor, the preferred embodiment takes measures to prepare multiple types of magnetic substances 342 whose permeability varies from one to another, and to provide the magnetic substances 342 which have the best suited permeability according to the magnetization of the permanent magnet 341. An example of compensating the variation in the magnetization is provided by the aid of FIG. 6. FIGS. 6A and 6B are distribution diagrams showing the variation in the saturation flux density, with FIG. 6A showing the permanent magnet 341 alone, while FIG. 6B shows the correction unit 340 in which the magnetic substances 342 are attached to the permanent magnet 341. Here, the saturation flux density is employed as an index to examine the variation of the magnetization.

Take notice that materials used here are, as stated above, $BaO.6Fe_2O_3$ as the main material of the permanent magnet 341, and an Fe—Ni or an Fe—Ni—Cr metal alloy for the magnetic substances 342.

As illustrated in FIG. 6A, the permanent magnet 341 alone shows ±6000 μT, i.e. ±10% variation in the saturation flux density due to the individual difference of the permanent magnets as manufactured.

On the other hand, in the preferred embodiment, the best suited magnetic substances 342 are attached to the end faces 341*a* and 341*b* of the permanent magnet 341, in consideration of the saturation flux density and the variation of the permanent magnet 341 observed in FIG. 6A above. Hereby, with the correction unit 340, the variation in the saturation flux density is reduced to ±1000 μT, i.e. ±2.5% as shown in FIG. 6B.

The method discussed hereinbefore enables compensation to be made for the variation in the magnetization (saturation flux density) of the permanent magnet 341 due to the individual difference as manufactured, and ensures reliable correction of the pincushion distortion in the CRT apparatus 1 by providing a correction unit 340, with ideal saturation flux density, to the deflection yoke 30.

Note that, when it comes to the actual manufacturing of the correction unit 340, in addition to making compensation for the variation in the magnetization of the permanent magnet due to the individual difference as cited above, adjustment for change in the magnetization of the permanent magnet 341 in response to temperature change of the apparatus becomes an important factor at the time of selecting the magnetic substances 342.

(6) Change in the Saturation Flux Density of the Correction Unit 340 at the Temperature Change of the Apparatus Next, as to change in the saturation flux density of the permanent magnet 341 and that of the correction unit 341, their difference when the temperature of the apparatus has been changed is described with reference to FIG. 7.

The permanent magnet 341 with the main material of $BaO.6Fe_2O_3$ as above generally has temperature characteristics where the magnetization (saturation flux density) is −0.2%/° C. Accordingly, as shown in FIG. 7, the magnetization of the permanent magnet 341 decreases as the temperature of the apparatus increases.

Alternatively, the magnetic substances 342 have the attribute, in which the permeability changes with the negative temperature characteristic, because of being made of the above metal alloy. Consequently, the correction unit 340, formed by attaching the magnetic substances 342 to the permanent magnet 341 so as to cover part of both end faces 341*a* and 341*b* and part of the lateral face 341*c*, has a largely steady saturation flux density against change in temperature, of 45000 μT.

Figure 7:
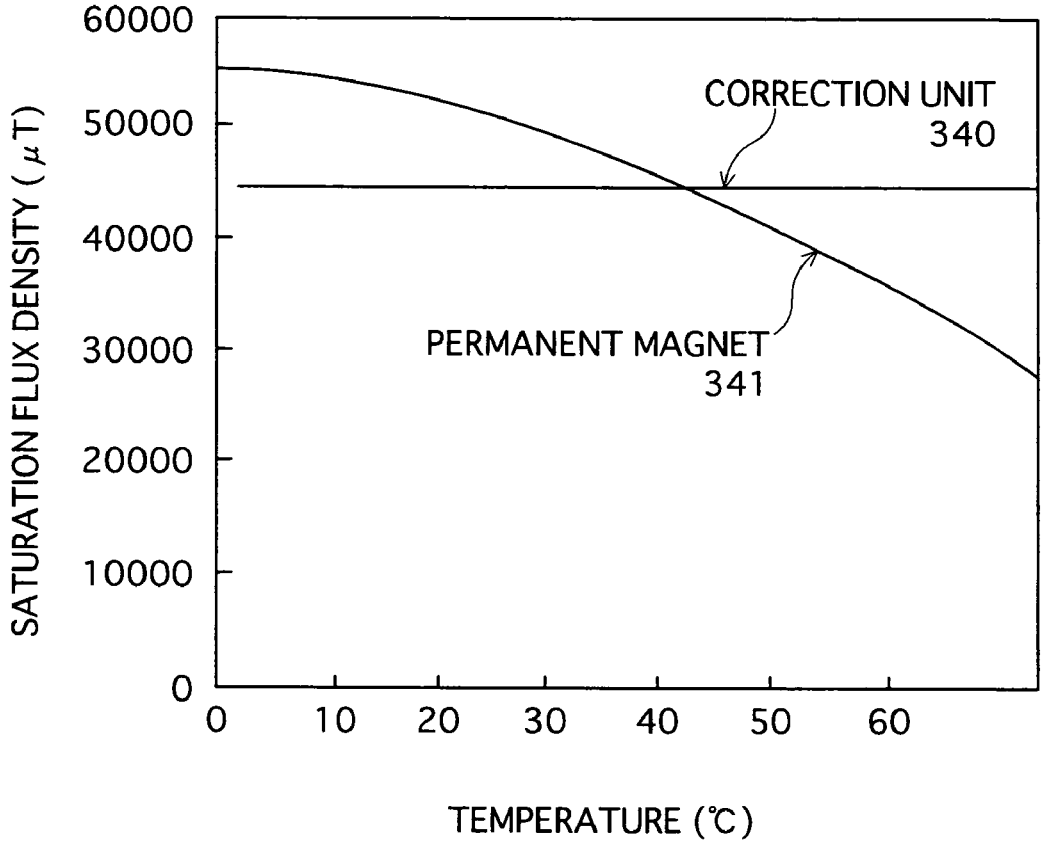
FIG. 7 is a diagram indicating respective attributes of the permanent magnet 341 and the correction unit 340 in terms of change in the saturation flux density in response to temperature change.

Stated differently, at the temperature of 0° C., the saturation flux density of the permanent magnet 341 alone is around 55000 μT, while that of the correction unit 340 is about 45000 μT due to cancellation of magnetic flux exerted by the magnetic substances 342, as illustrated in FIG. 7. Then, as aforesaid, the saturation flux density of the permanent magnet 341 alone changes at the rate of −0.2%/° C. as temperature increases.

As to the magnetic substances 342 with the attribute in which the permeability changes with a negative temperature characteristic, that is the permeability decreases with an increase in temperature and to influence of counteracting the change in magnetic flux diminishes. In this preferred embodiment, as shown in FIG. 7, the correction unit 340 maintains a stable saturation flux density regardless of temperature changes by keeping a balance between the decrease in the saturation flux density of permanent magnet 341 and the decrease in the permeability of the magnetic substances 342 in response to an increase in temperature.

As described hereinbefore, in the CRT apparatus 1 provided with the correction unit 340, correction of the pincushion distortion is maintained and performed without fail even if the temperature of the apparatus increases after the apparatus is activated. Resultantly, the CRT apparatus 1 consistently maintains high image quality, being free of influence from temperature changes.

Commonly, as to a CRT apparatus having a flat panel, the shadow mask of the CRT is tensed and then maintained. In such a case, in order to correct pincushion distortion, use of the permanent magnet 341 with a large magnetization is required for the correction unit 340, which is provided with the deflection yoke 30. Here, again, the structure of the correction unit 340 of the preferred embodiment above enables the effect stated above to be obtained.

(7) Modification of the Preferred Embodiment

Figure 8A:
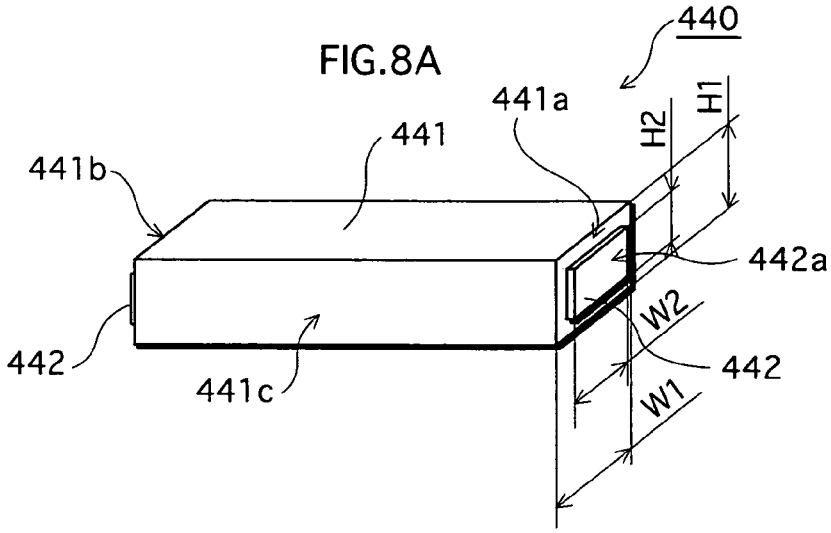
FIGS. 8A to 8C are perspective views of modified correction units 440, 540, and 640 of the present invention, respectively.
Figure 8B:
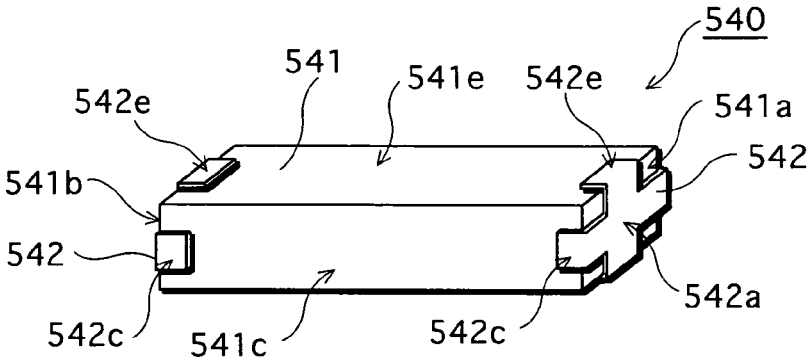
Figure 8C:
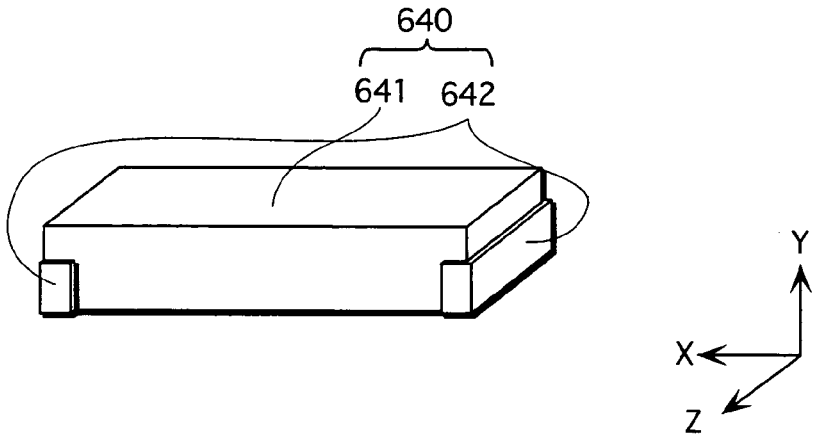
Figure 9A:
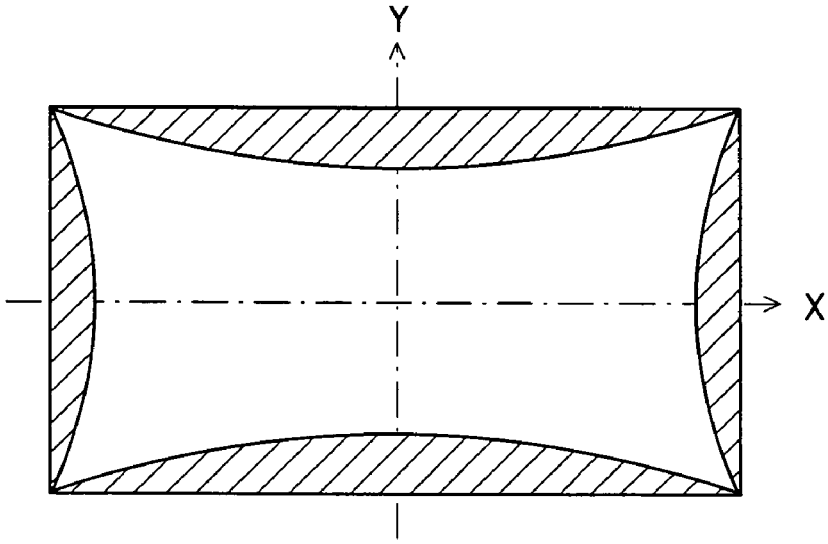
FIG. 9A is a pattern diagram illustrating pincushion distortion generated in a CRT apparatus.
Figure 9B:
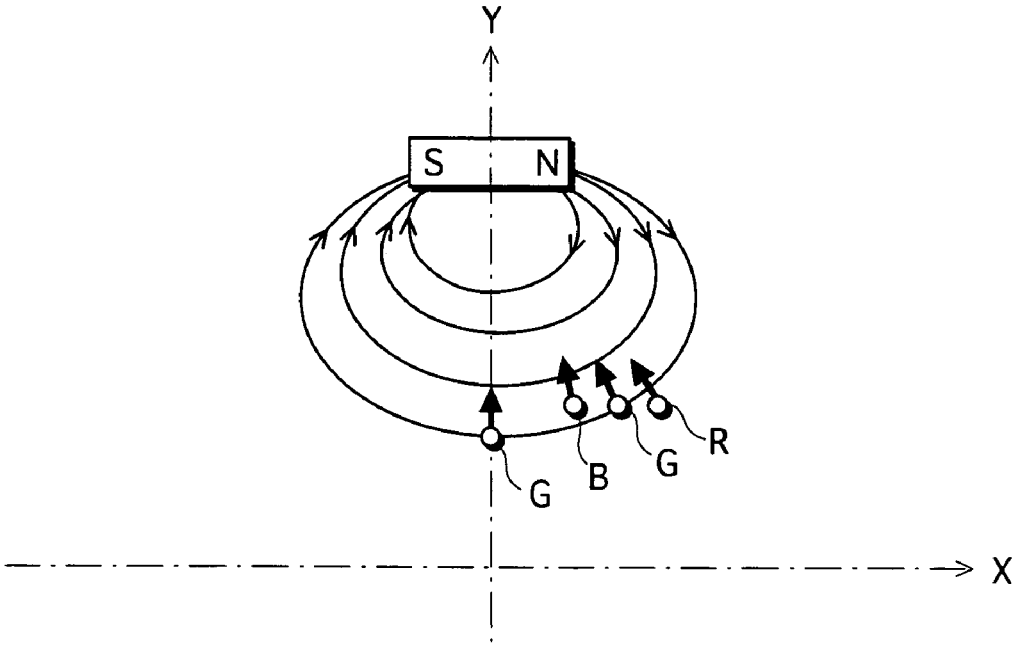
FIG. 9B is a conceptual diagram showing an influence of the permanent magnet provided with the deflection coil on electron beams.

Although the correction unit 340 of the preferred embodiment shown in FIG. 4 is used in the above CRT apparatus 1, the correction units 440, 540, and 640 of FIGS. 8A–8C can be used in order to achieve the above effect.

In the correction unit 440 illustrated in FIG. 8A, magnetic substances 442 are attached to both end faces 441*a* and 441*b*, which are the magnetic poles of the permanent magnet 441. In short, the difference of this modified correction unit 440 from the correction unit 340 of the above preferred embodiment is that the magnetic substances 442 are attached to the permanent magnet 441 without covering part of the lateral face 441*c*.

Table 1 shows examples of desirable dimensions for the magnetic substance 442 of the correction unit 440. Bear in mind that, the dimensions in Table 1 are obtained assuming that the end faces 441*a* and 441*b* of the permanent magnet 341 have dimensions H1=9.0 mm and W1=9.0 mm and the thickness of the magnetic substance 442 is 1 mm.

TABLE 1

| | The Magnetization of the Permanent Magnet (μT) | | |
|---|---|---|---|
| | 50000 | 60000 | 70000 |
| H2 (mm) | 4.0 | 4.0 | 4.0 |
| W2 (mm) | 5.0 | 7.0 | 9.0 |

As Table 1 indicates, it is advisable to increase the cross-sectional area (H2×W2) of the magnetic substance 442 in proportion to the magnetization of the permanent magnet 441. In these examples of the dimensions of the magnetic substance 442 shown in Table 1, the width W2 is varied while the thickness T and the height H2 are fixed at 1.0 mm and 4.0 mm, respectively. However, the values of the thickness T and the height H2 may be altered. In such cases, these values can be determined in view of the relationship between the permeability of the magnetic substance 442 to be used and the magnetization of the permanent magnet 441, as well as change in this relationship against temperature changes.

In the second modified correction unit 540 as illustrated in FIG. 8B, the magnetic substances 542 are attached to the permanent magnet 541 so as to cover part of both end faces 541*a* and 541*b*, which are magnetic poles of the permanent magnet 541, along with each part of the four lateral faces 541*c*, 541*e* . . . . Namely, the magnetic substances 542 are substantially cross-shaped having four open edges.

Furthermore, in the correction unit 640 shown in FIG. 8C, the magnetic substances 642, each in a square-bracket shape, are attached to both end faces of the permanent magnet 641, with the magnetic substances 642 placed on a lower half in the y-direction. Here, the downside in the y-direction in FIG. 8C corresponds to the side of the tube axis when the correction unit 640 is provided with the deflection yoke. In the case that the correction units 640 are used, in which the magnetic substances 642 are attached to the side in the end faces of the permanent magnet 641 closest to the electron beams, employing this structure allows the magnetic substances 642 to efficiently adjust a magnetic flux passing through the downside of the end faces, which has a great effect on the electron beams.

Note that the above modifications are mere examples of the present invention, and various modifications can be employed for variety of configurations in attaching the magnetic substances to the permanent magnet. In this regard, a point to take notice is that the magnetic substances need to be attached to the permanent magnet so as to cover the end faces, which are the magnetic poles of the permanent magnet, in order to increase the influence of the magnetic substances on the permanent magnet as described above.

(8) Additional Matters

In the preferred embodiment above, two correction units 340 are provided in pairs, each at the top and bottom of the foreside frame 300*a* of the deflection yoke 30. However, the correction unit 340 does not have to be a pair, and a single correction unit or more than one paired correction units may be provided. Note here that use of paired correction units is yet desirable from the aspect of a balance in the pincushion correction. Additionally, in the above preferred embodiment, the correction units 340 are provided in order to correct distortion in the vertical direction of the pincushion distortion in the panel, however, the correction unit 340 of the present invention may be applied to correct distortion in the horizontal direction.

Furthermore, the magnetic substances of the correction unit are not limited to those composed of the above materials provided that the magnetic substances have the attribute in which the permeability changes with a negative temperature characteristic.

FIG. 4 and FIG. 8 above illustrate embodiment examples of the correction units. However, the area, thickness, shape, and attachment position of the magnetic substances may be altered in compliance with the magnetization of the permanent magnet and the temperature characteristics thereof.

Locations for attaching the correction units 340 within the deflection yoke 30 are not limited to the preferred embodiment, in which two correction units 340 are placed at the locations shown in the above FIGS. 2 and 3. For instance, the correction units 340 do not necessarily need to be placed on the foreside frame 300*a*, but may be placed toward the side of the neck 13 of the CRT 10, or contrarily, toward the side of the panel 11. It is yet advisable to place the correction units 340 on the side in the deflection yoke 30 closest to the panel 11 in order to enhance the influence of the correction units 340.

In addition, respective components used in the CRT apparatus 1 in the preferred embodiment above are only examples, and it is obvious that the present invention is not confined to these. Again, as to the above modifications, the values shown in Table 1 are indicated by way of example, and therefore do not impose any limit on the present invention.

INDUSTRIAL APPLICABILITY

The deflection yoke and the CRT apparatus of the present invention have a beneficial effect on realization of a display apparatus used in a computer and a television set, especially of a display apparatus with a flat panel.

The invention claimed is:

1. A deflection yoke provided on a periphery of a cathode-ray tube, the deflection yoke applying a deflection magnetic field to an electron beam emitted towards a screen from an electron gun which is mounted in a neck of the cathode-ray tube, thereby controlling the electron beam to scan across the screen, including:

a magnet for adjusting an irradiated point of the electron beam on the screen; and a magnetic substance whose permeability changes with a negative temperature characteristic being attached on at least one of both end faces of the magnet which are S and N poles respectively.

2. The deflection yoke of claim 1, wherein the magnet is in a shape of a column that has one or more lateral faces, the magnetic substance includes a basal plane and two open edges extending from the basal plane, and is provided on the magnet in a manner that the basal plane spans one of the end faces covering a part of the one end face while each of the two open edges covers a part of the one or more lateral faces of the magnet.

3. The deflection yoke of claim 2, wherein the magnet has a rectangular cross-section with four lateral faces, and the magnetic substance has another two open edges extending from the basal plane, thereby having four open edges in total, and is attached to the magnet in a manner that each of the four open edges covers a part of the respective four lateral faces of the magnet.

4. The deflection yoke of claim 1, wherein the magnetic substance is made of a metal alloy containing at least one of Fe, Ni, and Cr.

5. The deflection yoke of claim 1, wherein the magnet is provided at a position on a frame of the deflection yoke, the position being to the screen side of the cathode-ray tube.

6. The deflection yoke of claim 5, wherein the magnet is provided in a pair with an identical magnet having an identical magnetic substance attached thereto, and the paired magnets are symmetrically positioned opposite to each other in-respect to a tube axis of the cathode-ray tube.

7. The deflection yoke of claim 6, wherein the magnetic substances have a substantially identical characteristic of permeability change in response to change in temperature.

8. A cathode-ray tube apparatus comprising:

a cathode-ray tube including a panel which contains a screen inside, a neck which mounts an electron gun positioned opposite to the panel, and a funnel which joints the panel and the neck, wherein an electron beam is emitted from the electron gun towards the screen; and a deflection yoke provided on a periphery of a cathode-ray tube, the deflection yoke applying a deflection magnetic field to an electron beam emitted towards a screen from an electron gun which is mounted in a neck of the cathode-ray tube, thereby controlling the electron beam to scan across the screen, wherein the deflection yoke includes:

a magnet for adjusting an irradiated point of the electron beam on the screen; and a magnetic; substance whose permeability changes with a negative temperature characteristic being attached on at lease one of both end faces of the magnet which are S and N poles respectively.

9. The cathode-ray tube apparatus of claim 8, wherein the magnet is in a shape of a column that has one or more lateral faces, the magnetic substance includes a basal plane and two open edges extending from the basal plane, and is positioned on the magnet in a manner that the basal plane spans one of the end faces covering a part of the one end face while each of the two open edges covers a part of the one or more lateral faces of the magnet.

10. The cathode-ray tube apparatus of claim 9, wherein the magnet has a rectangular cross-section with four lateral faces, and the magnetic substance has another two open edges extending from the basal plane, thereby having four open edges in total, and is attached to the magnet in a manner that each of the four open edges covers a part of the respective four lateral faces of the magnet.

11. The cathode-ray tube apparatus of claim 8, wherein the magnetic substance is made of a metal alloy containing at least one of Fe, Ni, and Cr.

12. The cathode-ray tube apparatus of claim 8, wherein the magnet is provided at a position on a frame of the deflection yoke, the position being to the screen side of the cathode-ray tube.

13. The cathode-ray tube apparatus of claim 12, wherein the magnet is provided in a pair with identical magnet having an identical magnetic substance attached thereto, and the paired magnets are symmetrically positioned opposite to each other in respect to a tube axis of the cathode-ray tube.

14. The cathode-ray tube apparatus of claim 13, wherein the magnetic substances have a substantially identical characteristic of permeability change in response to change in temperature.

15. The cathode-ray tube apparatus of claim 8, wherein a shadow mask is provided close to the screen, and the shadow mask is held in a tensed state.

16. A method for improving raster in a cathode-ray tube having a deflection yoke comprising the steps of:

selecting a permanent magnet;

determining a saturation flux density for the permanent magnet that is to be operatively mounted relative to the deflection yoke;

providing a plurality of individual magnetic substance members of different configurations;

selecting a pair of magnetic substance members of the same configuration from the plurality of individual magnetic substance members to correct any variation in the saturation flux density of the selected permanent magnet to within an approximate range of plus or minus 1000 μTeslas; and mounting the selected pair of magnetic substance members to the permanent magnet.

17. The method for improving raster in a cathode-ray tube of claim 16 wherein the pair of magnetic substances members is selected from a configuration group comprising a basal plane member, a basal plane member with two extensions configured to extend over two sides of the permanent magnet, and a member substantially cross shaped with extensions configured to extend over four sides of the permanent magnet.

18. The method for improving raster in a cathode-ray tube of claim 16 wherein the pair of magnetic substances members is further selected from a composition group comprising an Fe—Ni alloy and an Fe—Ni—Cr alloy.

19. The method for improving raster in a cathode-ray tube of claim 17 wherein each configuration group has a composition group comprising an Fe—Ni alloy and a Fe—Ni—Cr alloy and the pair of magnetic substance members is selected from the composition group.

* * * * *